United States Patent [19]

Okuyama et al.

[11] Patent Number: 5,049,847

[45] Date of Patent: Sep. 17, 1991

[54] DEFLECTION YOKE WITH AUXILIARY COILS FOR STRAY LINE RADIATION SUPPRESSION

[75] Inventors: Nobutaka Okuyama; Soichi Sakurai; Masao Obara, all of Yokohama; Yosio Kikkawa; Michitaka Ohsawa, both of Fujisawa, all of Japan

[73] Assignees: Hitachi, Ltd, Tokyo; Hitachi Mizusawa Electronics Co., Iwate, both of Japan

[21] Appl. No.: 450,573

[22] Filed: Dec. 14, 1989

[30] Foreign Application Priority Data

Dec. 19, 1988 [JP] Japan ..... 63-318566

[51] Int. Cl.[5] ..... H01H 1/00; H01H 5/00; H01J 29/06

[52] U.S. Cl. ..... 335/214; 335/213; 313/440; 315/8

[58] Field of Search ..... 335/210, 213, 214; 313/440; 315/8

[56] References Cited

U.S. PATENT DOCUMENTS

| | | | |
|---|---|---|---|
| 3,813,574 | 5/1974 | Sato | 315/29 |
| 4,639,708 | 1/1987 | Weatherly | 335/213 |
| 4,851,737 | 7/1989 | Johansson et al. | 335/213 |
| 4,857,805 | 8/1989 | Bosch et al. | 313/440 |
| 4,922,167 | 5/1990 | Sluyterman et al. | 335/213 |
| 4,947,083 | 11/1990 | Bosch et al. | 335/213 |

*Primary Examiner*—Leo P. Picard
*Assistant Examiner*—Ramon Barrera
*Attorney, Agent, or Firm*—Antonelli, Terry, Stout & Kraus

[57] ABSTRACT

At least two pairs of auxiliary coils are disposed externally on a deflection yoke at positions which are symmetric with respect to the central axis of a horizontal direction of said deflection yoke and which are separated from each other in the direction of the axis of a cathode ray tube. At least two pairs of auxiliary coils are respectively disposed in front of and at the back of the longitudinal center of a magnetic core. The auxiliary coils have a horizontal length which is longer than its another length. A horizontal deflecting current is supplied to the first pair of auxiliary coils in the direction in which unnecessary radiant magnetic fields generated in front of and at the back of the deflection yoke are suppressed, and a horizontal deflecting current is supplied to the second pair of auxiliary coils in the direction in which an unnecessary radiant magnetic field generated at the back of the deflection yoke is intensified. In consequence, unnecessary radiation can be suppressed simultaneously in front of and at the back of the deflection yoke by a correction apparatus which has a simple structure and which requires no large space.

8 Claims, 4 Drawing Sheets

DEFLECTION YOKE WITH AUXILIARY COILS FOR STRAY LINE RADIATION SUPPRESSION

BACKGROUND OF THE INVENTION

1. Field of the Invention

The present invention relates to a deflection yoke which is mounted on a cathode-ray tube, and more particularly, to a deflection yoke which is capable of suppressing the generation of unnecessary radiant magnetic fields.

2. Description of the Related Art

Conventional deflection yokes have been proposed in the specification of, for example, Japanese Patent Unexamined Publication No. 63-26928. This deflection yoke (the first conventional technique) has a pair of upper and lower loop-shaped cancelling coils for suppressing the generation of unnecessary radiant magnetic fields externally on a core and in the vicinity of a vertical axis. Japanese Patent Unexamined Publication No. 63-76245 discloses a deflection yoke (the second conventional technique) with two pairs of auxiliary coils for suppressing the generation of unnecessary radiant magnetic fields disposed along the sides of the horizontal deflection coil. Part of each of the coils is covered by a conductive shielding member.

In the first conventional technique, when the numbers of turns for the auxiliary coils are selected such that an unnecessary radiant magnetic field is completely cancelled on the side of the deflection yoke which is close to a fluorescent surface (hereinafter referred simply to as "in front of the deflection yoke"), the auxiliary coils generate an unnecessary radiant magnetic field having a polarity opposite to that of the unnecessary radiant magnetic field of the deflection yoke on the side of the deflection yoke which is close to an electron gun (hereinafter referred simply to as "at the back of the deflection yoke"). In the second conventional technique, shielding of the auxiliary coils makes the structure of the deflection yoke complicated. Furthermore, since the size of the auxiliary coils is large, the resultant deflection yoke requires a large space in an image display apparatus which employs it.

SUMMARY OF THE INVENTION

An object of the present invention is to provide a deflection yoke provided with an auxiliary means which is capable of suppressing the generation of unnecessary radiation simultaneously in front of and at the back of the deflection yoke, which has a simple configuration, and which requires only small space.

The above-described object of the present invention is achieved by the provision of a deflection yoke in which a first pair of upper and lower auxiliary coils provided on the side of the deflection yoke which is close to a fluorescent surface and a second pair of upper and lower auxiliary coils provided on the side of the deflection yoke which is close to an electron gun are separated from each other in the direction of the axis of a cathode-ray tube. A horizontal deflection current is supplied to the first pair of auxiliary coils in the direction in which the intensity of the unnecessary radiant magnetic fields generated in front of and at the back of the deflection yoke is decreased, and a horizontal deflection current is supplied to the second pair of auxiliary coils in the direction in which an unnecessary radiant magnetic field generated at the back of the deflection yoke is intensified.

The above-described object of the present invention is also achieved by the provision of a deflection yoke in which a pair of upper and lower auxiliary coils, whose loops are formed such that the central axes of the windings are deviated from each other, are disposed externally on the deflection yoke in such a manner that the loops of the auxiliary coils are inclined with respect to a horizontal plane. A horizontal deflection current is supplied to the auxiliary coils.

In the present invention, the first pair of auxiliary coils generate, in front of and at the back of the deflection yoke, correction magnetic fields in the direction opposite to that of the unnecessary radiant magnetic fields caused by high-frequency horizontal deflection magnetic fields. As a result, the unnecessary radiant magnetic field generated in front of the deflection yoke is substantially cancelled, and the unnecessary radiant magnetic field generated at the back of the deflection yoke is excessively corrected, resulting in the generation of an unnecessary radiant magnetic field having a polarity opposite to that of the original unnecessary radiant magnetic field. At the same time, the second pair of auxiliary coils generate, in front of the deflection yoke, a correction magnetic field which substantially affects no unnecessary radiant magnetic field. The second pair of auxiliary coils also generate, at the back of the deflection yoke, a correction magnetic field in the same direction as that of the unnecessary radiant magnetic field caused by the horizontal deflection magnetic field. In consequence, the unnecessary radiant magnetic field remaining at the back of the deflection yoke as the consequence of the correction by the first pair of auxiliary coils can be corrected by the second pair of auxiliary coils, thereby enabling unnecessary radiant magnetic fields to be cancelled in front of and at the back of the deflection yoke.

In a case where the auxiliary coils, whose loops are formed such that the central axes of the windings are deviated from each other, are disposed in such a manner that the loops of the coils are inclined with respect to a horizontal plane, the auxiliary coils generate magnetic fields having intensities substantially the same as those of the unnecessary radiant magnetic fields generated by the deflection yoke in front thereof and at the back thereof, and being in the direction opposite to that of the unnecessary radiant magnetic fields. The unnecessary radiant magnetic field generated in front of the deflection yoke has a large intensity, and the unnecessary radiant magnetic field generated at the back of the deflection yoke has a small intensity. In consequence, the unnecessary radiant magnetic fields generated in front of and at the back of the deflection yoke can be cancelled.

DETAILED DESCRIPTION OF THE EMBODIMENTS

Figure 1A:
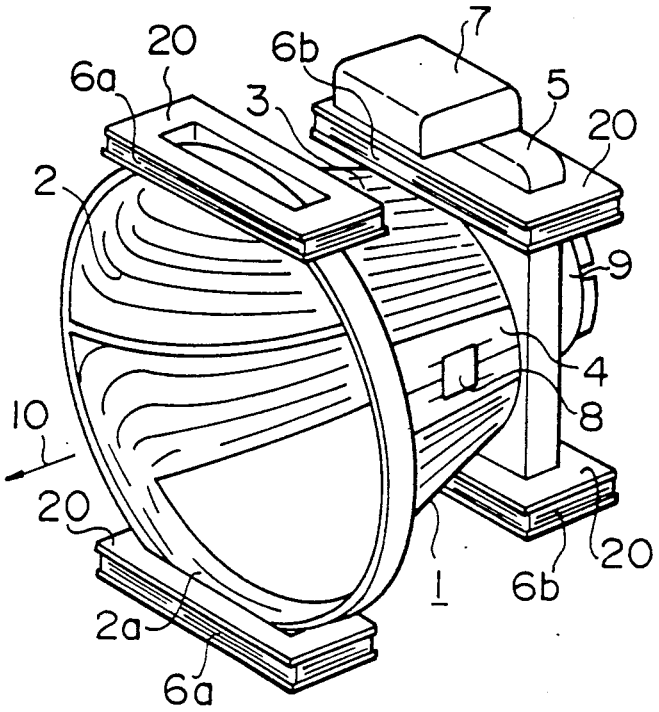
FIG. 1A is a perspective view of a deflection yoke showing a first embodiment of the present invention.
Figure 1B:
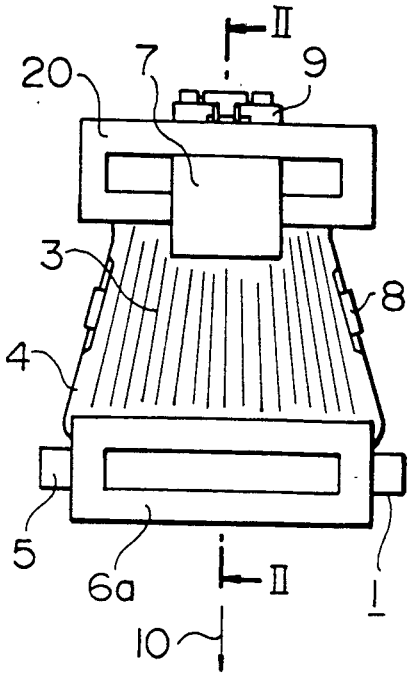
FIG. 1B is a plan view of the deflection yoke of FIG. 1A.

A first embodiment of the present invention will now be described with reference to FIGS. 1A and 1B. In FIGS. 1A and 1B, a reference numeral 1 denotes a deflection yoke, 2: a horizontal deflection coil, 3: a vertical deflection coil, 4: a magnetic core, 5: a separator, 6a: a first pair of auxiliary coils, 6b: a second pair of auxiliary coils, 7: a terminal cover, 8: a core clamp, 9: a tightening band, and 10: an arrow indicating the front of the deflection yoke.

In this embodiment, a pair of upper and lower auxiliary coils 6a are provided on the side of the deflection yoke which is close to a fluorescent surface, and a pair of upper and lower auxiliary coils 6b are provided on the side of the deflection yoke which is close to an electron gun, as shown in FIGS. 1A and 1B. Each of the auxiliary coils 6a and 6b is wound around a bobbin 20. The auxiliary coils 6a and 6b are mounted on the deflection yoke in such a manner that transverse conductors 2a and 2b of the horizontal deflection coil are located within the loops of the auxiliary coils, and that the loops of the auxiliary coils 6a and 6b are substantially in a horizontal plane.

Figure 2:
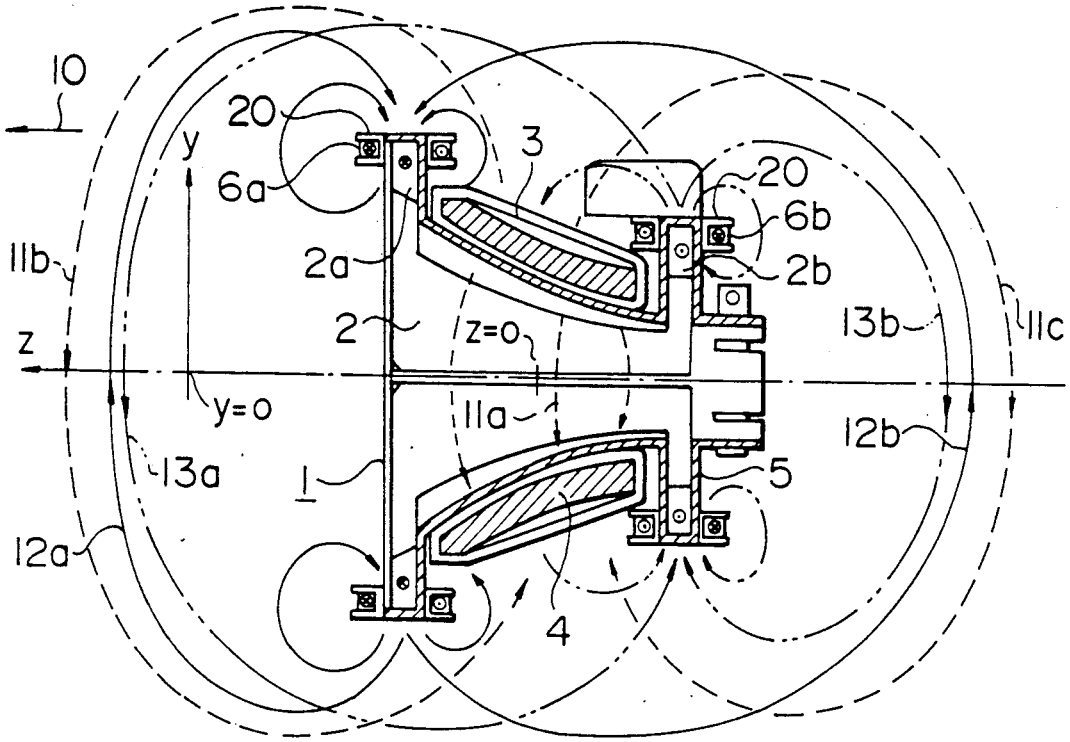
FIG. 2 is a cross-sectional view taken along the line II—II of FIG. 1B.
Figure 3:
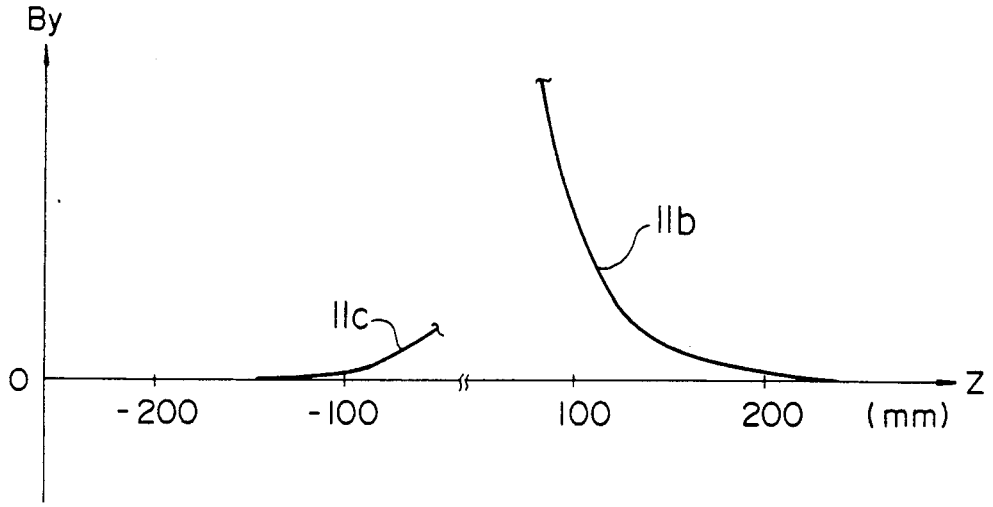
FIG. 3 is a graph showing distribution of a magnetic field generated by horizontal deflection coils of a conventional deflection yoke.

As shown in FIG. 2, when a horizontal deflection current flows through the horizontal deflection coil 2, a horizontal deflection current which flows in the directions indicated in FIG. 2 is supplied to the auxiliary coils 6a and 6b, which may be connected in series with the horizontal deflection coil 2. Alternately, the auxiliary coils 6a and 6b may be connected in parallel with the horizontal deflection coil 2 if the impedance of the auxiliary coils 6a and 6b is high. At that time, the horizontal deflection coil 2 generates a downward deflection magnetic field 11a. The horizontal deflection coil 2 also generates downward leakage magnetic fields 11b and 11c in front of and at the back of the deflection yoke, respectively. The intensity of the leakage magnetic field 11b generated in front of the deflection yoke is large, while that of the leakage magnetic field 11c is small, as shown in FIG. 3. The first pair of auxiliary coils 6a generate upward magnetic fields 12a and 12b in front of and at the back of the deflection yoke, respectively. The magnetic field 12a has an intensity larger than that of the magnetic field 12b. As a result, the leakage magnetic field generated in front of the deflection yoke is cancelled, whereas the leakage magnetic field generated at the back of the deflection yoke is corrected excessively, resulting in the generation of an upward magnetic field. The second pair of auxiliary coils 6b generate downward magnetic fields 13a and 13b in front of and at the back of the deflection yoke, respectively. The magnetic field 13b has an intensity larger than that of the magnetic field 13a. In consequence, the leakage magnetic fields generated in front of and at the back of the deflection yoke can be cancelled by setting the numbers of turns for the first and second pairs of auxiliary coils 6a and 6b to optimal values, and generation of the unnecessary radiant magnetic fields from the deflection yoke caused by leakage of the high-frequency horizontal deflection magnetic field can thereby be suppressed simultaneously in front of and at the back of the deflection yoke. The auxiliary coils 6a and 6b have a simple loop-shaped configuration, and requires no large space for installation.

Figure 4:
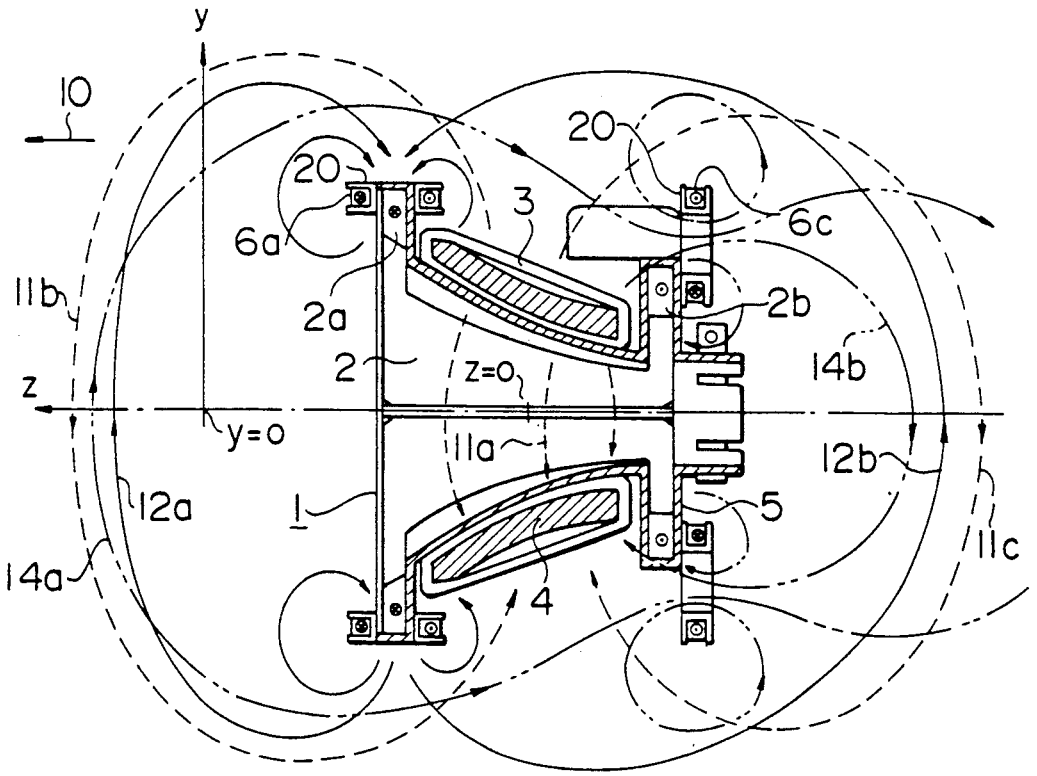
FIG. 4 is a cross-sectional view of a deflection yoke showing a second embodiment of the present invention.

Next, a second embodiment of the present invention will be described below with reference to FIG. 4. Like the first embodiment shown in FIG. 2, a first pair of upper and lower auxiliary coils 6a are provided on the side of the deflection yoke 1 which is close to the fluorescent surface. A second pair of upper and lower auxiliary coils 6c are provided on the side of the deflection yoke which is close to the electron gun in such a manner that the loops thereof are perpendicular to the axis of the tube (z axis). A horizontal deflection current which flows in the directions indicated in FIG. 4 is supplied to the auxiliary coils 6a and 6c. Hence, when the horizontal deflection coil 2 generates the downward horizontal deflection magnetic field 11a as well as the downward leakage magnetic fields 11b and 11c in front of and at the back of the deflection yoke respectively, the first pair of auxiliary coils 6a generate the magnetic fields 12a and 12b in the direction in which the leakage magnetic fields 11b and 11c are cancelled. As a result, the leakage magnetic field is cancelled in front of the deflection yoke, and the leakage magnetic field is corrected excessively at the back of the deflection yoke, resulting in the generation of an upward magnetic field. The second pair of auxiliary coils 6c generate a downward magnetic field 14b at the back of the deflection yoke, and an upward magnetic field 14a having a slightly small intensity in front of the deflection yoke. In consequence, the leakage magnetic fields from the deflection yoke can be cancelled by setting the numbers of turns for the first and second pairs of auxiliary coils 6a and 6c to optimal values, and generation of the unnecessary radiant magnetic fields can thereby be suppressed in front of and at the back of the deflection yoke.

In the second embodiment, the second pair of auxiliary coils 6c generate, in front of the deflection yoke 1, the magnetic field 14a having a polarity opposite to that of the leakage magnetic field 11b of the deflection yoke. In consequence, the numbers of turns for the first and second pairs of auxiliary coils 6a and 6c can be reduced from those of the first embodiment when unnecessary radiant magnetic fields are to be suppressed in front of and at the back of the deflection yoke.

Figure 5A:
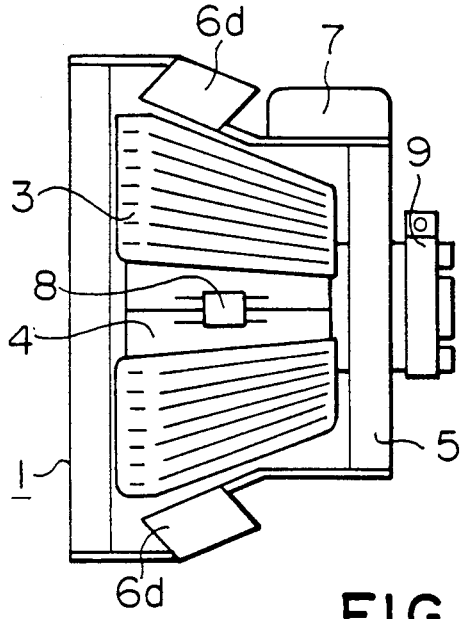
FIG. 5A is a side-elevational view of a deflection yoke showing a third embodiment of the present invention.
Figure 5B:
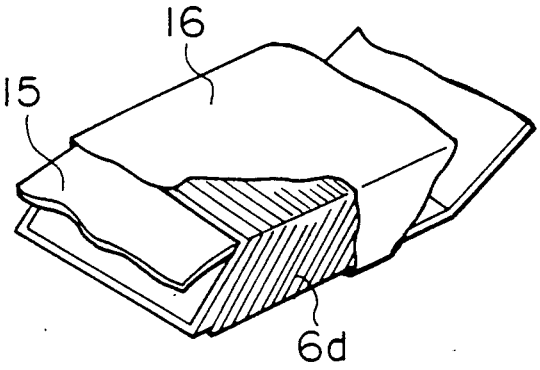
FIG. 5B is a perspective view of the essential parts of the deflection yoke of FIG. 5A.
Figure 6:
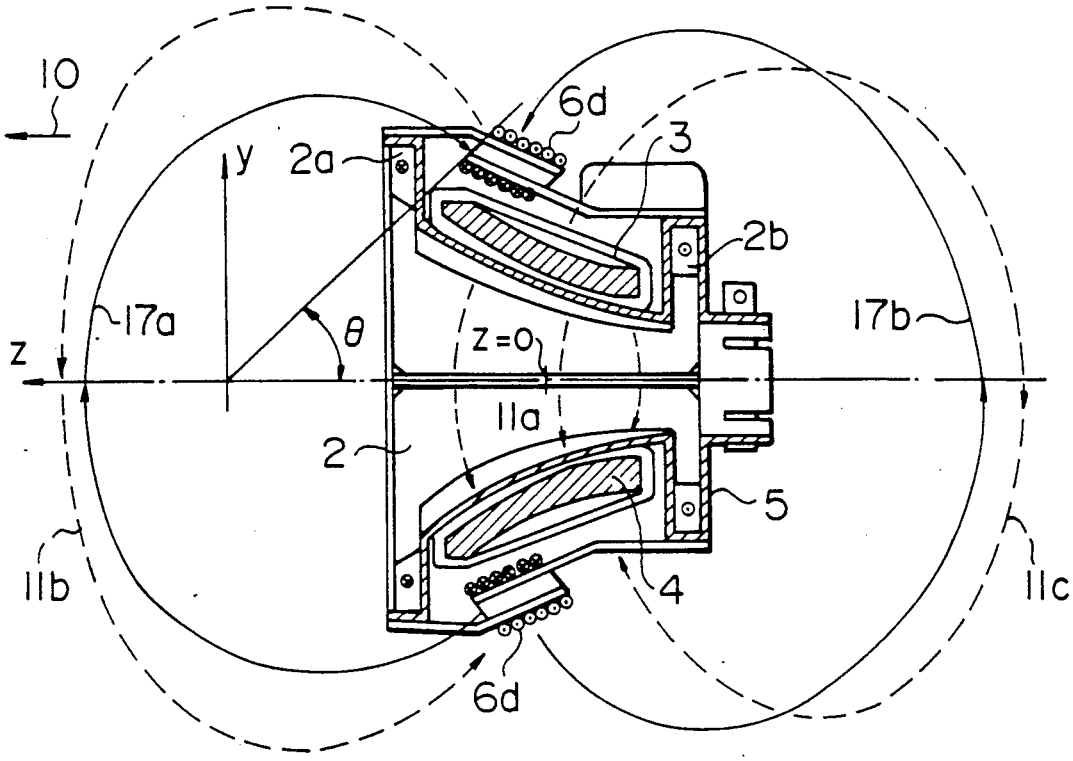
FIG. 6 is a cross-sectional view of the third embodiment of the present invention.

A third embodiment of the present invention will be described below with reference to FIGS. 5A, 5B and 6. A pair of upper and lower auxiliary coils 6d are provided externally on the deflection yoke 1. The vertical cross-section of the loop of the auxiliary coils 6d substantially has the form of a parallelogram, so as to allow the centers of the windings to be deviated from each other. Each of the auxiliary coils 6d is formed as follows. A wire is wound substantially in the form of a parallelogram. This coil is mounted on a retaining member 15, and the outer surface of the coil with the retaining member 15 is covered by an insulating member 16. Each of the auxiliary coils 6d is disposed such that the loop formed by the auxiliary coil 6d is inclined at an angle $\theta$ with respect to the axis of the tube (z axis). A horizontal deflection current having a polarity shown in FIG. 6 is supplied to the auxiliary coils 6*d*, and this generates an upward magnetic field 17*a* in front of the deflection yoke and a magnetic field 17*b* whose direction changes from upward to downward, as the angle $\theta$ increases, at the back of the deflection yoke. In consequence, when the numbers of turns and the angle $\theta$ for the auxiliary coils 6*d* are set to optimal values, the magnetic fields 17*a* and 17*b* generated by the auxiliary coils 6*d* have intensities substantially equal to those of the magnetic fields 11*b* and 11*c* generated in front of and at the back of the deflection yoke 1 by the horizontal deflection coil 2 and have a polarity opposite to those of the magnetic fields 11*b* and 11*c*. As a result, leakage magnetic fields can be cancelled, and generation of the unnecessary radiant magnetic fields can be thereby suppressed. In this embodiment, unnecessary radiant magnetic fields can be prevented by one pair of auxiliary coils which require a small space for installation.

Figure 7A:
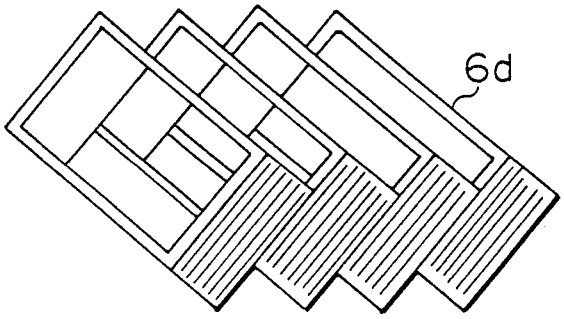
FIGS. 7A and 7B show another example of the auxiliary coil employed in the third embodiment.
Figure 7B:
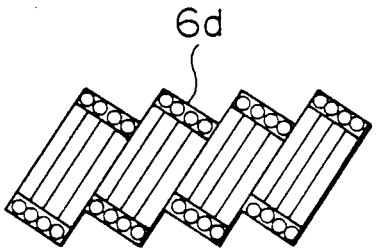

FIGS. 7A and 7B show another example of the auxiliary coils 6*d*. In this example, the vertical cross-section of the loop of the coil has stages. The use of such auxiliary coils ensures the same effect as that of the third embodiment.

Figure 8:
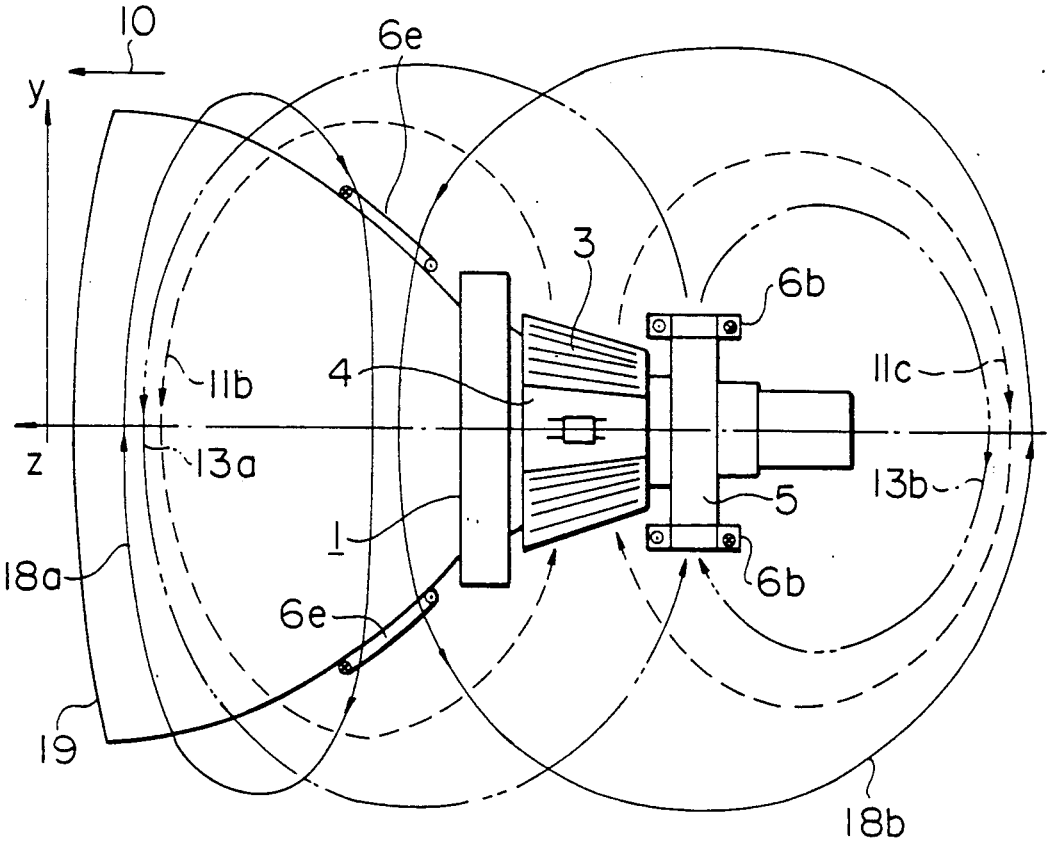
FIG. 8 is a side-elevational view of a cathode-ray tube showing a fourth embodiment of the present invention.

A fourth embodiment of the present invention will be described below with reference to FIG. 8. A first pair of upper and lower auxiliary coils 6*e* for generating magnetic fields 18*a* and 18*b* which cancel the leakage magnetic fields 11*b* and 11*c* generated in front of and at the back of the deflection yoke are mounted on a cathode-ray tube 19. The second pair of auxiliary coils 6*b* for generating the magnetic fields 13*a* and 13*b* in the same direction as that of the leakage magnetic fields 11*b* and 11*c* are mounted on the side of the deflection yoke which is close to the electron gun in the same manner as that in the first embodiment shown in FIG. 2. A horizontal deflection current is supplied to the auxiliary coils 6*b* and 6*e*. The intensity of the magnetic field 18*a* is larger than that of the magnetic field 18*b*, and the intensity of the magnetic field 13*b* is larger than that of the magnetic field 13*a*. In consequence, when the numbers of turns for the auxiliary coils 6*b* and 6*e* are set to optimal values, the magnetic fields generated by the auxiliary coils 6*b* and 6*e* have intensities substantially the same as those of the leakage magnetic fields 11*b* and 11*c* from the deflection yoke 1 and a direction opposite to that of the magnetic fields 11*b* and 11*c*. As a result, the leakage magnetic fields 11*b* and 11*c* can be cancelled and generation of the unnecessary radiant magnetic fields can thereby be suppressed in front of and at the back of the deflection yoke. In this embodiment, the first pair of auxiliary coils 6*e*, having a large loop which ensures a small inductance and the same effect, are provided on the cathode-ray tube 19 where there is less limitation to the space for installation. In consequence, only one pair of auxiliary coils 6*b* are mounted on the deflection yoke 1, and this is effective in reducing the overall size of the deflection yoke as well as the horizontal deflection power.

It is clear that the auxiliary coils employed in this invention may be one in which the number of turns or the surface area thereof is reduced by inserting a magnetic material within the loop formed by the auxiliary coils.

As will be understood from the foregoing description, according to the present invention, since the auxiliary coils generate the magnetic fields having intensities substantially the same as those of the leakage magnetic fields generated in front of and at the back of the deflection yoke by the horizontal deflection coil in the direction opposite to that of the leakage magnetic fields, the leakage magnetic fields can be cancelled and generation of the unnecessary radiant magnetic fields can thereby be suppressed simultaneously in front of and at the back of the deflection yoke. Furthermore, since the auxiliary coils for generating magnetic fields which cancel unnecessary radiant magnetic fields can be shaped in the form a small loop and no shielding is necessary, they have a simple configuration and require no large space for installation.

What is claimed is:

1. A deflection apparatus for a cathode-ray tube comprising:

a deflection yoke including:

a magnetic core having a longitudinal axis and a longitudinal center lying on the longitudinal axis, the magnetic core having a front end lying in front of the longitudinal center and a back end lying in back of the longitudinal center;

a vertical deflection coil disposed on the magnetic core and being responsive to a low-frequency vertical deflection current; and a horizontal deflection coil disposed on the magnetic core and being responsive to a high-frequency horizontal deflection current;

the deflection apparatus further comprising:

a first pair of auxiliary coils disposed on the deflection yoke symmetrically about the longitudinal axis in front of the longitudinal center and being responsive to the horizontal deflection current; and a second pair of auxiliary coils disposed on the deflection yoke symmetrically about the longitudinal axis in back of the longitudinal center and being responsive to the horizontal deflection current;

wherein each of the auxiliary coils has a first dimension extending in a direction transverse to the longitudinal axis, and a second dimension extending in a direction transverse to the direction in which the first dimension extends, the first dimension being greater than the second dimension.

2. A deflection apparatus according to claim 1, wherein the front end of the magnetic core is disposed towards a fluorescent screen of the cathode-ray tube and the back end of the magnetic core is disposed towards and electron gun of the cathode-ray tube, and wherein each of the auxiliary coils is disposed adjacent to a respective portion of the horizontal deflection coil extending in a direction transverse to the longitudinal axis.

3. A deflection apparatus according to claim 2, wherein the deflection yoke has a vertical deflection direction extending substantially perpendicular to the longitudinal axis, wherein each of the auxiliary coils is formed in the shape of a loop, and wherein the first pair of auxiliary coils is disposed such that the loops thereof are substantially perpendicular to the vertical deflection direction, and the second pair of auxiliary coils is disposed such that the loops thereof are substantially perpendicular to the longitudinal axis.

4. A deflection apparatus for a cathode-ray tube comprising:

a deflection yoke including:

a magnetic core;

a vertical deflection coil disposed on the magnetic core and being responsive to a low-frequency vertical deflection current; and a horizontal deflection coil disposed on the magnetic core and being responsive to a high-frequency horizontal deflection current;

the deflection apparatus further comprising:

a pair of auxiliary coils, wherein each of the auxiliary coils is formed of loop-shaped windings having respective central axes which are deviated from each other, and wherein the pair of auxiliary coils are respectively disposed on upper and lower portions of the deflection yoke such that the loop-shaped windings are inclined with respect to a horizontal plane of the deflection yoke.

5. A deflection apparatus according to claim 1, wherein each of the auxiliary coils has a vertical cross-section having the shape of a parallelogram.

6. A deflection apparatus according to claim 1, wherein each of the auxiliary coils has a vertical cross-section having steps.

7. An image display apparatus comprising:

a cathode-ray tube;

a deflection yoke disposed on the cathode-ray tube and including a magnetic core having a longitudinal axis and a longitudinal center lying on the longitudinal axis, the magnetic core having a front end lying in front of the longitudinal center and a back end lying in back of the longitudinal center;

a first pair of auxiliary coils respectively disposed on upper and lower portions of the deflection yoke in front of the longitudinal center and being responsive to a horizontal deflection current of the image display apparatus; and a second pair of auxiliary coils respectively disposed on upper and lower portions of the deflection yoke in back of the longitudinal center and being responsive to the horizontal deflection current;

wherein each of the auxiliary coils has a first dimension extending in a direction transverse to the longitudinal axis, and a second dimension extending in a direction transverse to the direction in which the first dimension extends, the first dimension being greater than the second dimension.

8. An image display apparatus comprising:

a cathode-ray tube;

a deflection yoke disposed on the cathode-ray tube and including a magnetic core having a longitudinal axis and a longitudinal center lying on the longitudinal axis, the magnetic core having a front end lying in front of the longitudinal center and a back end lying in back of the longitudinal center;

a first pair of auxiliary coils respectively disposed on upper and lower portions of the cathode-ray tube in front of the longitudinal center and being responsive to a horizontal deflection current of the image display apparatus; and a second pair of auxiliary coils respectively disposed on upper and lower portions of the deflection yoke in back of the longitudinal center and being responsive to the horizontal deflection current;

wherein each of the auxiliary coils has a first dimension extending in a direction transverse to the longitudinal axis, and a second dimension extending in a direction transverse to the direction in which the first dimension extends, the first dimension being greater than the second dimension.

* * * * *